United States Patent [19]

Miles

[11] 4,300,736

[45] Nov. 17, 1981

[54] FIRE CONTROL SYSTEM

[75] Inventor: Perry A. Miles, Lexington, Mass.

[73] Assignee: Raytheon Company, Lexington, Mass.

[21] Appl. No.: 68,860

[22] Filed: Aug. 17, 1979

[51] Int. Cl.[3] ..... F41G 7/00

[52] U.S. Cl. ..... 244/3.13; 244/3.22

[58] Field of Search ..... 244/3.13, 3.21, 3.14, 244/3.22

[56] References Cited

U.S. PATENT DOCUMENTS

| | | | |
|---|---|---|---|
| 2,958,282 | 11/1960 | Czajkowski et al. | 244/3.22 |
| 3,000,597 | 9/1961 | Bell et al. | 244/3.21 |
| 3,028,807 | 4/1962 | Burton et al. | 244/3.22 |
| 3,141,635 | 7/1964 | Davis et al. | 244/3.22 |
| 3,255,984 | 6/1966 | Hawes | 244/3.13 |
| 3,374,967 | 3/1968 | Plumley | 244/3.22 |
| 3,501,113 | 3/1970 | Maclusky | 244/3.13 |
| 3,843,076 | 10/1974 | King et al. | 244/3.22 |
| 3,964,053 | 6/1976 | Heiser | 244/3.13 |
| 3,979,089 | 9/1976 | Miller et al. | 244/3.21 |
| 4,014,482 | 3/1977 | Esker et al. | 244/3.13 |
| 4,111,383 | 9/1978 | Allen et al. | 244/3.13 |
| 4,200,251 | 4/1980 | Borjesson et al. | 244/3.13 |
| 4,219,170 | 8/1980 | Esker | 244/3.14 |
| 4,220,296 | 9/1980 | Hesse | 244/3.14 |

*Primary Examiner*—Sal Cangialosi

*Attorney, Agent, or Firm*—Philip J. McFarland; Joseph D. Pannone

[57] ABSTRACT

A fire control system is shown wherein the relative rotational motion between a modulated beam of infrared energy and a spinning projectile is used to determine the displacement of such a projectile during flight from the centerline of such beam so that the trajectory of such projectile may be corrected as required to enable a selected target to be hit.

1 Claim, 6 Drawing Figures

FIRE CONTROL SYSTEM

BACKGROUND OF THE INVENTION

This invention pertains generally to fire control systems and particularly to systems of such type wherein the trajectory of a projectile in flight is controlled.

It has been proposed that so-called "beam riding" techniques be adapted to use with cannon-launched projectiles such as artillery shells. Thus, it has been proposed continuously to illuminate a projectile in flight with a coded beam of electromagnetic energy (the longitudinal centerline of such beam being controlled to follow the true ballistic trajectory of a projectile toward a selected target) and then to derive command signals within the projectile in flight in order to allow any deviation between the true and the actual ballistic trajectories to be corrected. Unfortunately, however, hitherto proposed beam riding techniques require that some means be provided in a cannon-launched projectile continuously to measure roll attitude when the projectile is in flight. While it is possible to use a roll gyroscope for such purpose (or to polarize the energy in the transmitted beam in some detectable manner), a penalty must be paid in terms of complexity and cost of the system.

SUMMARY OF THE INVENTION

With the background of the invention in mind, it is a primary object of this invention to provide an improved beam-riding system for guiding cannon-launched projectiles.

Another object of this invention is to provide a system as above in which relative rotational motions of a transmitted beam of infrared energy and of a cannon-launched projectile are sensed to allow correction of any deviation between the true and actual ballistic trajectories of such projectile to be made.

The foregoing and other objects of this invention are attained generally by: Generating a divergent beam of infrared energy modulated by a spinning recticle with alternate transparent and opaque spokes of the same width, directing such beam to follow the true ballistic trajectory of a spinning cannon-launched projectile to a selected target; detecting such beam with a sensor mounted on such projectile to produce an electrical signal indicative of the deviation of such projectile from the true ballistic trajectory; and then, in accordance with the electrical signal, changing the flight path of such projectile to eliminate such deviation.

BRIEF DESCRIPTION OF THE DRAWINGS

For a more complete understanding of this invention, reference is now made to the following description of the accompanying drawings wherein.

DESCRIPTION OF THE PREFERRED EMBODIMENT

Figures 1, 1A, 1B, 1C:
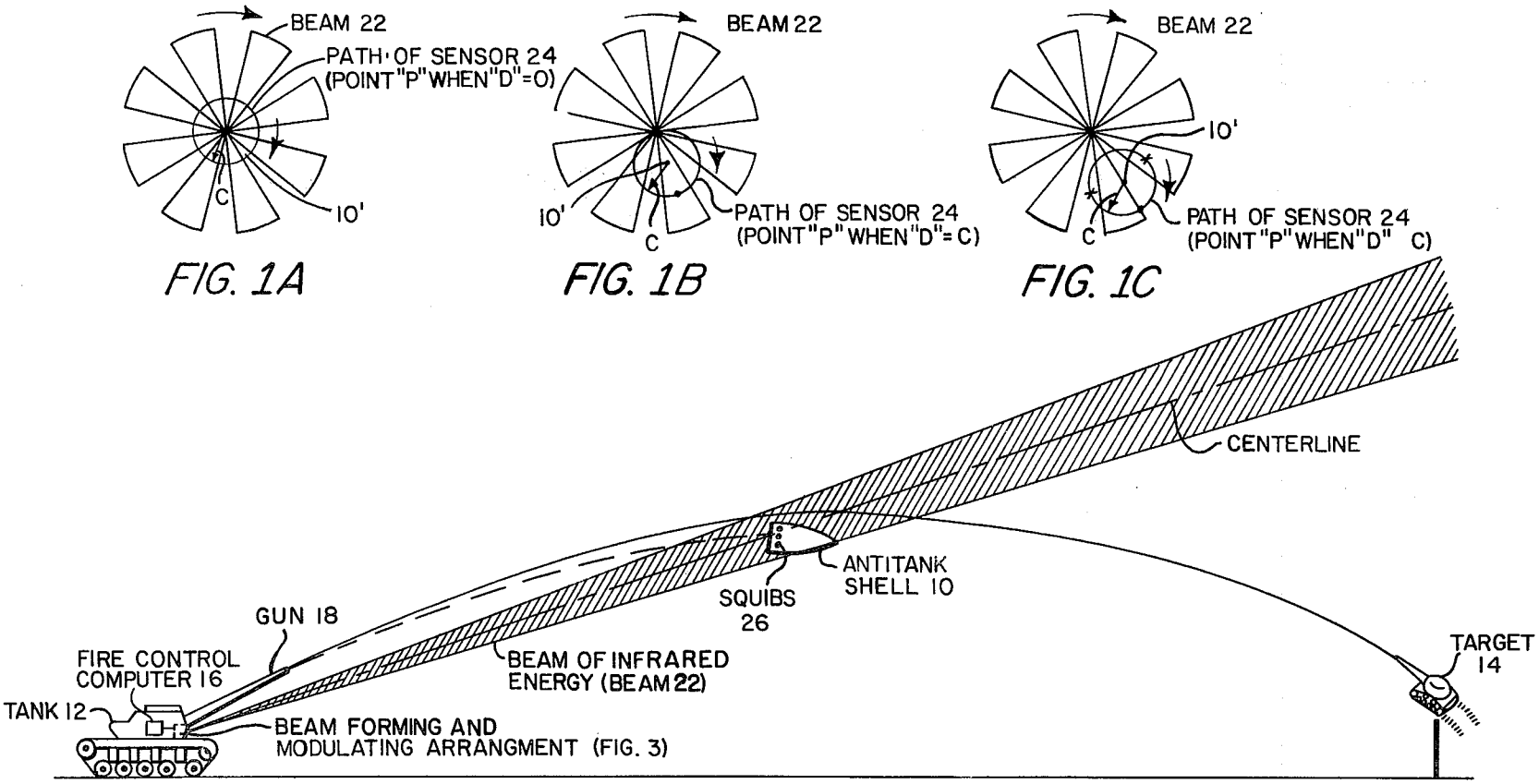
FIG. 1 is a sketch showing an exemplary tactical situation in which the invention would be used.
FIGS. 1A, 1B and 1C are sketches which illustrate the underlying principles of this invention.

Referring now to FIG. 1, the illustrated tactical situation is seen to be one in which a cannon-launched projectile, here an antitank shell 10, is in flight from a tank 12 toward a target 14, here another tank. A conventional fire control computer 16, in response to range and bearing information derived in any known manner, produces aiming command signals, i.e., elevation, azimuth and firing commands for a gun 18. The fire control computer 16 also calculates the true trajectory (shown in full line) of the antitank shell 10 and directs a beam of infrared energy (hereinafter sometimes referred to as the beam 22) so that the centerline of such beam coincides, as the flight of the antitank shell 10 goes on, with the true trajectory. As indicated in FIG. 1, the actual trajectory (shown in broken line) of the antitank shell 10 is assumed to differ from the true trajectory. That is to say, because of dispersion, anomalies in the air or other sources of ballistic error, the actual trajectory of the antitank shell 10 differs from the true trajectory. One of a number of squibs 26 arranged around the outside of the antitank shell 10 is then fired to move the center of such shell into coincidence with the centerline of the beam 22.

Referring now to FIGS. 1A, 1B and 1C, it may be seen that the relative motion between a point near the periphery of the rear of the rotating antitank shell 10 (FIG. 1) and the rotating image of the reticle in space is dependent upon the position of the center of such shell with respect to the centerline of the beam 22. Thus, as shown in FIG. 1A, when the center of the antitank shell 10' coincides with the centerline of the beam 22, there is a constant difference between the velocity of a point "p" (the assumed point near the periphery of the antitank shell 10, FIG. 1) and any point in the beam 22 on a circle of the same radius as the circle "c". A moment's thought will make it clear, then, that if a sensor 24 were to be assumed to be at the point "p", an electrical signal of constant frequency would be produced.

In FIG. 1B, the radius of the circle "c" is assumed to be equal to the displacement of the center of the antitank shell 10' from the centerline of the beam 22. The relative motion between the point "p" and an underlying point in the beam 22 then constantly changes, passing through a point of singularity when the point "p" coincides with the centerline of the beam 22. In this case then, if the sensor 24 is assumed to be at the point "p", the frequency of the electrical signal out of such sensor constantly changes (except at the point of singularity where the electrical signal disappears).

In FIG. 1C, the displacement of the center of the antitank shell 10' from the centerline of the beam 22 is assumed to be greater than the radius of such shell. The relative motion here (where the direction of rotation of the antitank shell 10' is the same as that of the image of the reticle in space) varies from a maximum when the point "p" is nearest to the centerline of the beam 22 to a minimum when the point "p" is furthest from such centerline. It follows then that, if the sensor 24 is assumed to be at the point "p", the frequency of the electrical signal out of the sensor 24 similarly varies.

It may be shown that the frequency, f(t), of the electrical signal out of the sensor 24 in the case shown in FIG. 1C may (neglecting noise) be expressed as:

$$f(t)=f_R=(2\pi R/D)[Nf_S \sin(2\pi f_S t+A)] \qquad \text{Eq. (1)}$$

where $f_R$ is the frequency generated by the rotation of the beam image;

N is the number of spokes in the image of the reticle in space;

R is the radius of the antitank shell 10;

$f_s$ is the spin frequency of the antitank shell 10;

A is an initial phase constant; and

D is the displacement of the center of the antitank shell 10 from the center of the beam 22.

In the contemplated case, there are eight spokes in the image of the reticle in space with such image rotating at a rate of 100 revolutions per second. The spin frequency of the antitank shell 10 is twenty revolutions per second and the radius of the antitank shell is 4.1 cms. The deviation between the maximum and minimum frequencies out of the sensor 24 is inversely proportional to the displacement of the antitank shell 10 from the centerline of the beam; and the maximum and minimum frequencies occur when the relative speeds between the sensor 24 and the rotating image of the reticle in space are, respectively, also a maximum and a minimum. As noted hereinbefore, the greatest and least such relative speeds here occur when the sensor 24 passes, respectively, through the minimum and maximum distances from the centerline of the beam 22. It follows, then, that the points of inflection of the electrical signal out of the sensor 24 lie on a radius of the beam 22. Therefore, with the positions of the squibs 26 (relative to the sensor 24) known, the time for firing any one of the squibs 26 to impart a thrust to the antitank shell 10 to move that body toward the centerline of the beam 22 may readily be determined.

Figure 2:
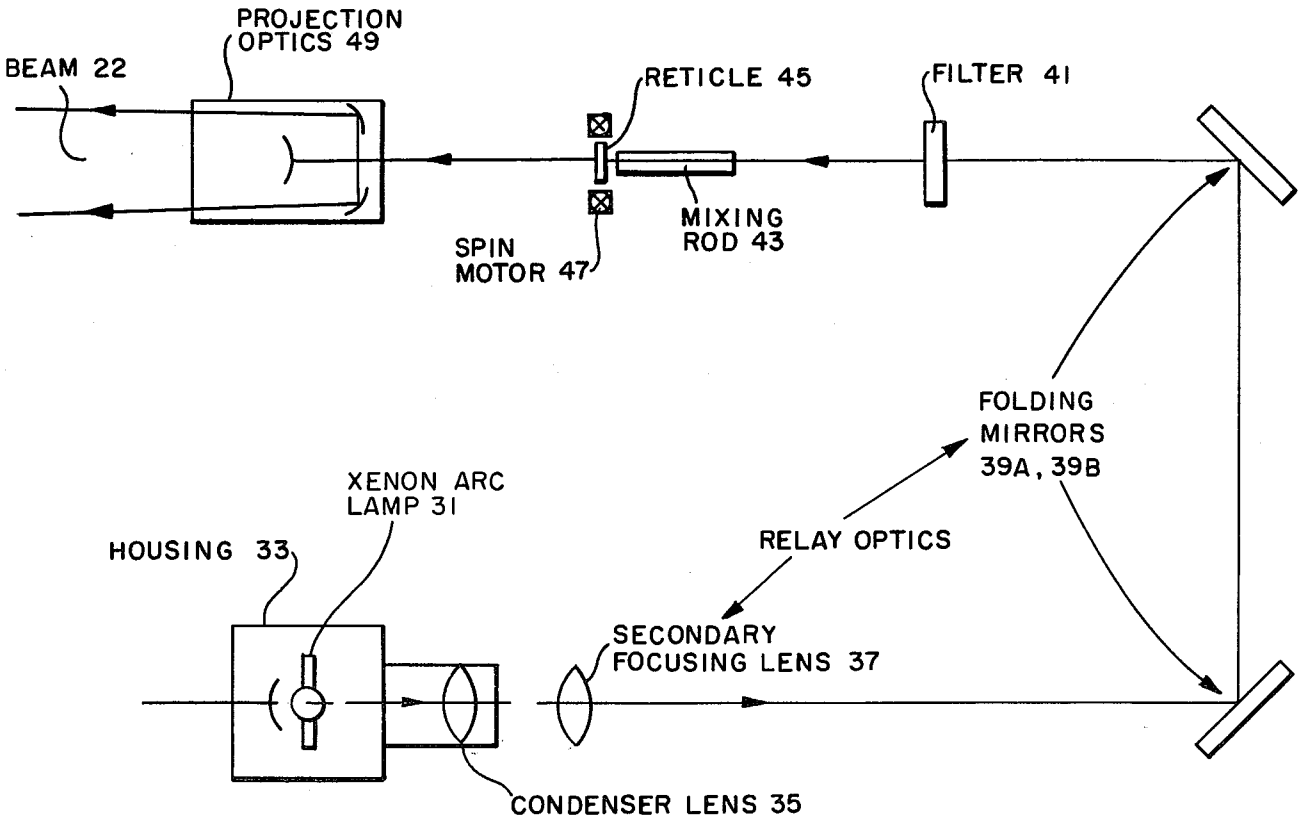
FIG. 2 is an optical schematic drawing of a beam forming and modulating arrangement.

Referring now to FIG. 2, it will be observed that the requisite beam directing mechanism (required to move the beam along the true ballistic trajectory of the antitank shell 10 (FIG. 1)) has not been shown because it is felt that the details of such a mechanism would be obvious to one of skill in the art. With the foregoing in mind, the illustrated beam-forming and modulating arrangement is shown to consist of an Xenon arc lamp 31 continuously energized from a source, not shown, mounted within a housing 33 containing a condenser lens 35. The latter two elements here are parts of a conventional arrangement such as the Model 6144 housing and lens manufactured by Oriel Corporation, Stamford, Connecticut. The partially formed beam is passed through relay optics (secondary focusing lens 37 and folding mirrors 39A, 39B) to a filter 41. The latter is chosen to pass only infrared energy. The partially formed and now filtered beam is directed to one end of a mixing rod 43. The latter is a cylindrical member transparent to the infrared and polished so that total internal reflections occur along its six-inch length. With the diameter of the mixing rod approximately equal to the diameter of a reticle 45, it is evident that the image of the arc of the Xenon arc lamp is changed to an even illumination of the reticle 45. The latter here is a radial configuration of eight pairs of alternating transparent and opaque spokes. The opaque spokes are formed by depositing a metal (here Inconel although other metals may be used) on a glass substrate transparent to the infrared energy in the partially formed and filtered beam. The reticle 45 is here rotated at a constant speed of 100 revolutions per second by a spin motor 47 so that light (chopped at the rate of 800 Hz) is passed through conventional projection optics 49 ultimately to form the beam 22.

Figure 3:
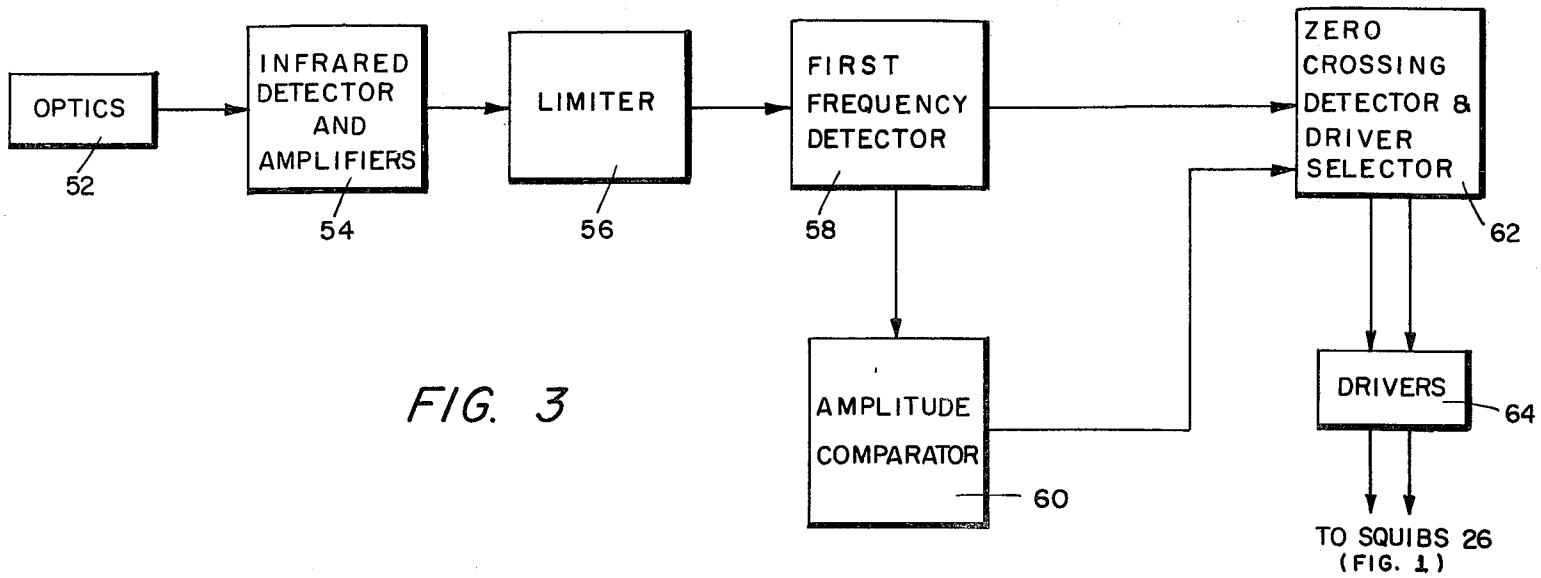
FIG. 3 is a simplified block diagram of electronic circuitry carried by a cannon-launched projctile.

Referring now to FIG. 3, it may be seen that the infrared energy in the beam 22 (FIG. 1) falling on the antitank shell 10 (FIG. 1) is passed through a conventional optical arrangement (labeled optics 52) to be focused on an infrared detector 54 (here a single element silicon P-I-N diode, type SGD-444, manufactured by E G & G, Inc., Wellesley, Massachusetts). The output of the latter is passed through bandpass amplifiers (not numbered) to a limiter 56 to suppress any amplitude fluctuations. The signal is then passed to a first frequency detector 58, here a conventional phase locked loop wherein the changing level of the drive voltage to an oscillator (not shown) required to match the frequency of the signal is a measure of the instantaneous frequency of signal. When such drive signal is compared in an amplitude comparator 60 with a reference signal indicative of a predetermined displacement of the antitank shell 10 (FIG. 1) from the centerline of the beam 22 (FIG. 1) and is found to be greater, an enable firing signal is produced. The time varying drive voltage in the first frequency detector 58 is passed to a zero crossing detector of conventional design to produce a signal whenever the drive voltage to the oscillator (not shown) in the first frequency detector passes through zero volts. A moment's thought will make it clear that: (a) a zero crossing occurs whenever the sensor 24 (FIG. 1) is on a line orthogonal to the line from the center of the antitank shell 10 to the centerline of the beam 22 (FIG. 1); and (b) the instantaneous frequency out of the sensor 24 (FIG. 1) at the time of each zero crossing is determined solely by rotational movement of the image in space of the reticle 45 (FIG. 2). Here such movement results in an instantaneous frequency of 800 Hz out of the sensor 24 (FIG. 1) which occurs twice during each period of rotation of the antitank shell 10 (FIG. 1) as indicated in FIG. 1(C).

Having determined that the displacement of the antitank shell 10 (FIG. 1) from the centerline of the beam 22 (FIG. 1) exceeds a predetermined value (meaning that the actual trajectory of the antitank shell 10 differs from the true trajectory of such shell by more than a tolerable amount) and that the direction of such displacement from the centerline of the beam 22 (FIG. 1) is known relative to the sensor 24 (FIG. 1), it now is necessary simply to fire the particular one (or ones) of the squibs 26 (FIG. 1) which will impart the necessary lateral thrust impulse through the center of gravity of the antitank shell 10 (FIG. 1). It will be obvious to one of skill in the art that the problem initially is simply to provide a firing signal to the first one of the squibs 26 (FIG. 1) to be positioned on the line defined by the centers of the beam 22 (FIG. 1) and of the antitank shell 10 (FIG. 1) away from such centers and then, as necessary, a firing signal for successively so-positioned ones of the squibs. Appropriate logic circuitry, say, for example, a circulating shift register having the same number of stages as squibs 26 (FIG. 1) and enabled when the signal out of the amplitude comparator 60 indicates a correction should be made, is here provided as a driver selector to allow the appropriate one of a like number of drivers 64 to be actuated.

Having described a preferred embodiment of the invention, it will now be apparent to one of skill in the art that many modifications may be made without departing from the disclosed concept of projecting an image of a rotating reticle to actuate a sensor on a rotating artillery shell to provide an electrical signal indicative of the deviation of such shell from the center of such image. For example, the directions of rotation of the rotating image and artillery shell may be opposite to each other, the wavelength of the energy in the rotating image may be varied and the number of spokes in the rotating reticle may be changed. It is felt, therefore, that this invention should not be restricted to its disclosed embodiment, but rather should be limited only by the spirit and scope of the appended claims.

What is claimed is:

1. A fire control system for guiding a rotating artillery shell in flight from a gun to a target, such system comprising:

(a) sensor means, disposed at a point near the periphery of the base of the rotating artillery shell, for producing an electrical signal in response to infrared energy impinging upon such means;

(b) means for projecting a beam of infrared energy to impinge on the sensor means, such beam being modulated by the image of a rotating reticle whereby the resulting electrical signal out of the sensor means is indicative of the spacing and direction between the centers of such beam and projectile; and (c) means for nulling the spacing between the centers of the beam and the rotating projectile, such means comprising a plurality of explosive squibs disposed about the rotating shell and logic circuitry, responsive to the resulting electrical signal out of the sensor means, to produce a firing signal when the spacing between the centers of the beam and the projectile exceeds a predetermined value and an unfired one of the explosive squibs is positioned to null, when fired, such spacing.

* * * * *